US008272980B1

(12) United States Patent
Johnson

(10) Patent No.: US 8,272,980 B1
(45) Date of Patent: Sep. 25, 2012

(54) JACKET HAVING AN ACCESS SECTION FOR INSERTION AND REMOVAL OF AN INFLATABLE BLADDER

(76) Inventor: Ronald B. Johnson, Casa Grande, AZ (US)

( * ) Notice: Subject to any disclaimer, the term of this patent is extended or adjusted under 35 U.S.C. 154(b) by 261 days.

(21) Appl. No.: 12/798,369

(22) Filed: Apr. 1, 2010

(51) Int. Cl.
*A63B 41/08* (2006.01)

(52) U.S. Cl. ..... 473/603; 473/599; 473/573; 473/608

(58) Field of Classification Search ..... 473/598, 473/599, 603, 607, 608, 570, 573, 575; 273/DIG. 30
See application file for complete search history.

(56) References Cited

U.S. PATENT DOCUMENTS

| | | | | | |
|---|---|---|---|---|---|
| 1,431,732 | A | * | 10/1922 | Hoppes | 473/608 |
| 1,692,305 | A | * | 11/1928 | Jacobus | 473/603 |
| 1,853,008 | A | * | 4/1932 | Turner | 473/603 |
| 1,900,544 | A | * | 3/1933 | Craig | 473/608 |
| 1,972,909 | A | | 9/1934 | Turner | |
| 2,116,479 | A | * | 5/1938 | Reach | 473/604 |
| 2,623,747 | A | | 12/1952 | Rcrowley | |
| 2,627,892 | A | | 2/1953 | Fenton | |
| 3,251,075 | A | | 5/1966 | Saltness | |
| 3,426,891 | A | | 2/1969 | Marks | |
| 3,506,265 | A | | 4/1970 | Hiroshi | |
| 3,653,084 | A | | 4/1972 | Hartman | |
| 4,660,831 | A | | 4/1987 | Kralik | |
| 5,035,426 | A | * | 7/1991 | Spector | 473/599 |
| 5,123,869 | A | * | 6/1992 | Schipmann | 446/46 |
| 5,413,331 | A | | 5/1995 | Stillinger | |
| 5,522,757 | A | | 6/1996 | Ostrowski | |
| 5,577,732 | A | * | 11/1996 | Spector | 473/576 |
| 5,709,623 | A | | 1/1998 | Schwaner | |
| 5,735,776 | A | | 4/1998 | Swezey et al. | |
| 5,772,543 | A | * | 6/1998 | Paino | 473/594 |
| 6,059,676 | A | * | 5/2000 | Seymour et al. | 473/570 |
| 6,398,677 | B1 | | 6/2002 | Hergert et al. | |
| 6,500,082 | B1 | | 12/2002 | Ou | |
| 6,547,703 | B1 | | 4/2003 | Swezey et al. | |
| 6,638,189 | B2 | | 10/2003 | Chang | |
| 6,645,100 | B2 | | 11/2003 | Guenther et al. | |
| 6,712,745 | B1 | | 3/2004 | Lynne | |
| 6,752,732 | B2 | | 6/2004 | Morrison et al. | |
| 6,793,597 | B2 | | 9/2004 | Awan | |
| 7,077,769 | B2 | * | 7/2006 | Buschfort | 473/570 |
| 7,141,011 | B2 | | 11/2006 | Williams et al. | |
| 7,427,246 | B2 | * | 9/2008 | Taniguchi et al. | 473/605 |
| 7,485,058 | B1 | * | 2/2009 | Payne et al. | 473/607 |
| 7,645,203 | B2 | * | 1/2010 | Tang et al. | 473/604 |
| 7,753,813 | B2 | * | 7/2010 | Taniguchi et al. | 473/605 |
| 2006/0229149 | A1 | * | 10/2006 | Goedoen | 473/598 |
| 2011/0165979 | A1 | * | 7/2011 | Cohen et al. | 473/605 |

OTHER PUBLICATIONS

Honeyman Enterprises—website www.honeymanenterprises.com Website created—Sep. 16, 2005.

* cited by examiner

*Primary Examiner* — Steven Wong
(74) *Attorney, Agent, or Firm* — Booth Udall, PLC

(57) ABSTRACT

A jacket for an inflatable bladder such as an exercise ball. The jacket has a durable cover with an access section having an inner panel defining an access opening. Outer panels overlie the inner panel and have edges which extend across the opening and are provided with closures. In use, the outer panels may be separated at fasteners so a bladder may be removed or inserted through the access opening. The inner panel and the outer panels may be a woven material with their weave oriented to resist distortion when the bladder is inflated and to assist in securing the closure. The cover may be any suitable material such as a coated nylon providing durability.

20 Claims, 4 Drawing Sheets

JACKET HAVING AN ACCESS SECTION FOR INSERTION AND REMOVAL OF AN INFLATABLE BLADDER

FIELD OF THE INVENTION

The present invention relates to a jacket for an inflatable bladder, particularly bladders that when inflated within a jacket comprise a ball. The jacket provides a protective cover to enhance durability, appearance and even comfort which cover is provided with a generous access section to facilitate convenient and easy insertion and removal of the bladder within the jacket. The access section has inner and outer panels which are oriented to resist stretch and to assist in closing the access section.

BACKGROUND OF THE INVENTION

There are a wide variety of inflatable bladders. Bladders are commonly used as one piece inflatable balls for recreation, training and fitness. These type of inflatable bladders are often constructed of PVC, rubber or other elastomeric material and are variously referred to as exercise balls, sports balls, therapy balls, yoga balls and Swiss balls. The term "exercise ball" is used to collectively refer to these types of balls.

Because balls of this type having inflatable bladders are subject to puncture, wear and tear, and soiling, these types of bladders are sometimes provided with a jacket which serves as a protective covering which can be removed and periodically replaced or cleaned.

When it becomes necessary to clean the jacket or replace or repair the bladder, a problem often encountered by the user is that it may be difficult to remove the bladder from the conventional jacket. The opening in the conventional jacket is often relatively small making it difficult to remove and reinsert the bladder even when deflated. When the bladder is reinflated, there may be noticeable distortion at the opening resulting from concentrated stress at the opening and adjacent locations such as the seams of the jacket.

BRIEF SUMMARY OF THE INVENTION

The present invention provides a jacket that may be applied to inflatable bladders. The term "bladder" is used herein to refer to a structure which, when inflated, may be spherical or other shape and which may be used for exercise, recreation and similar purposes.

When either the bladder is damaged or the jacket of a larger size ball such as an exercise ball is damaged or becomes soiled, the separate bladder and jacket components must be separated. Convenient disassembly and removal of the jacket from the bladder facilitates cleaning of the jacket for both improved appearance and sanitation. A deficiency exists with prior art jackets as the openings in these jackets are often small and extend along seams so that the stress applied when inserting and removing the bladder may cause tearing or separation of the seams. Further, prior art ball jackets do little or nothing to resist distortion and maintain the spherical condition or other shape of the bladder once inflated.

The present invention provides a jacket for inflatable bladders. The jacket has a cover which encases the bladder and the cover has an access section. The user inserts the bladder within the jacket cover through the access section and inflates the bladder so the jacket is tight fitting and the bladder is firm and properly shaped within the cover. The bladder may be deflated and removed through the access section when necessary for cleaning, repair or replacement of the cover or bladder.

The jacket cover access section comprises an inner access panel having a relatively large access opening such as a circular or oval opening sized to accommodate convenient insertion and removal of the bladder. The jacket cover is sized and shaped to snugly and tightly encase the bladder once the bladder is inflated. The inner panel of the access section reinforces the cover by resisting and distributing the distorsional forces due to the pressure exerted once the bladder is inflated. With the present invention, higher bladder inflation pressures may be applied for improved performance.

Outer closure panels having closure flaps overlie the inner panel. The outer closure panels are secured about their periphery to the cover and to the inner panel by stitching, welding, adhesive, bonding or other fastening method. The flaps on the outer closure panels are separable along adjacent or overlying edges at an opening which extends across the access opening in the inner panel. The two adjacent edges of the outer closure flaps are provided with suitable fasteners such as sections of hook-and-loop fastener material, such as that sold under the trademark Velcro®, so they may be sealed over the opening. If the cover, inner and outer panels are a fabric woven material, the weave of the inner panel is oriented to resist stretch perpendicular to the closure and the weave of the flaps of the outer panels are oriented to allow stretch to assist in closure.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
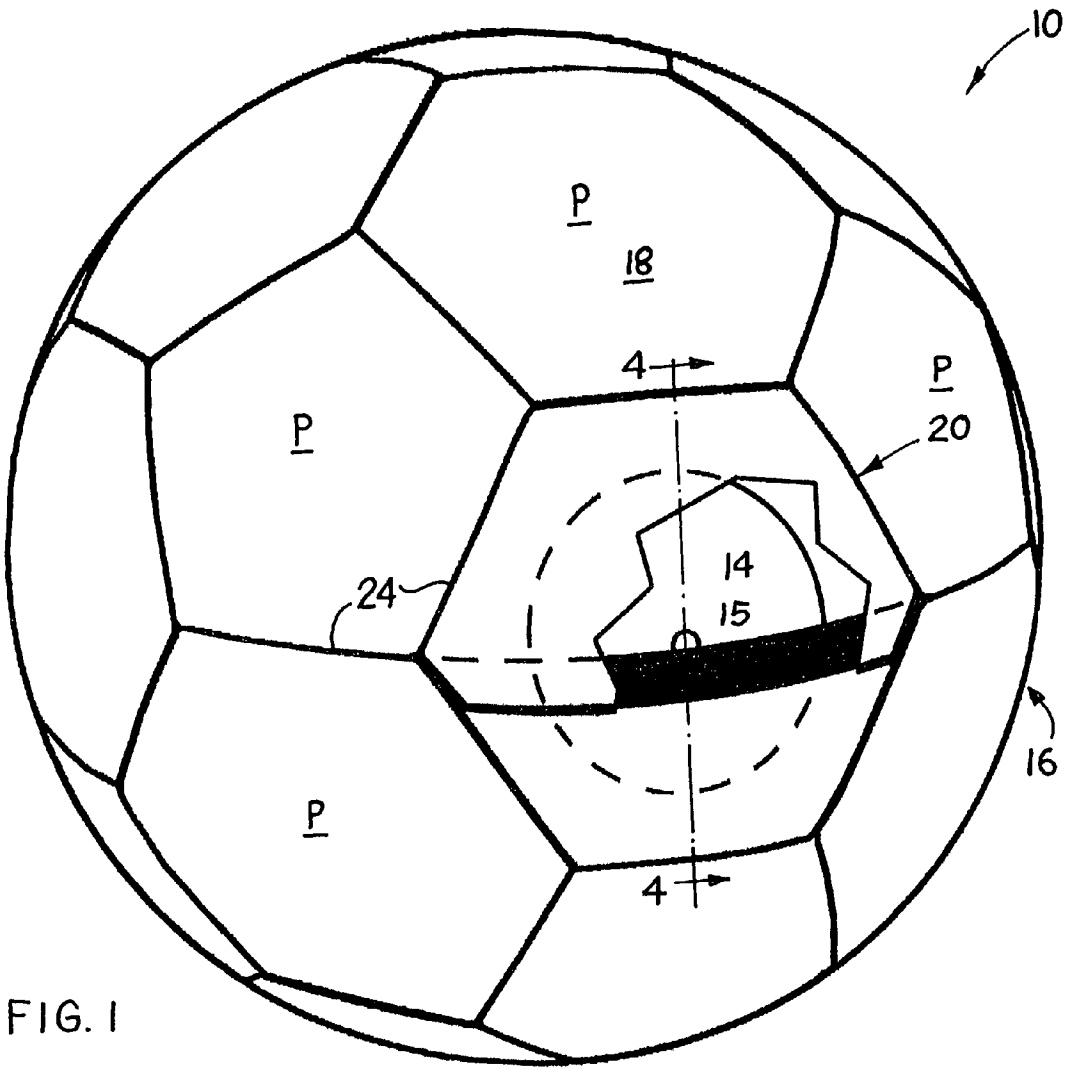
FIG. 1 is a perspective view of a representative inflatable bladder provided with a jacket comprising a ball which has been partly broken away to illustrate the inner access panel and bladder.
Figure 2:
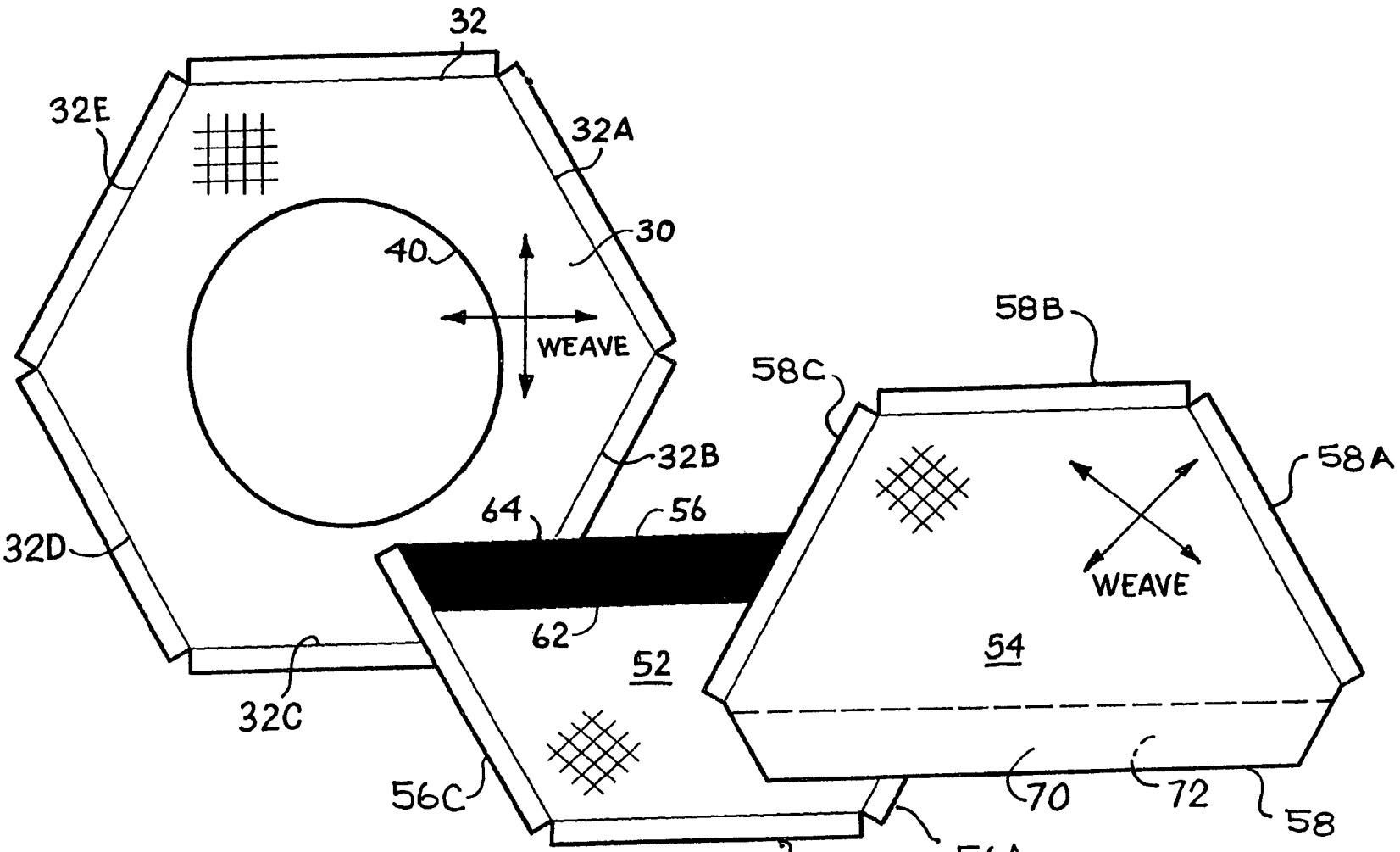
FIG. 2 is an exploded view showing the inner access panel and outer panel of the access section.
Figure 4:
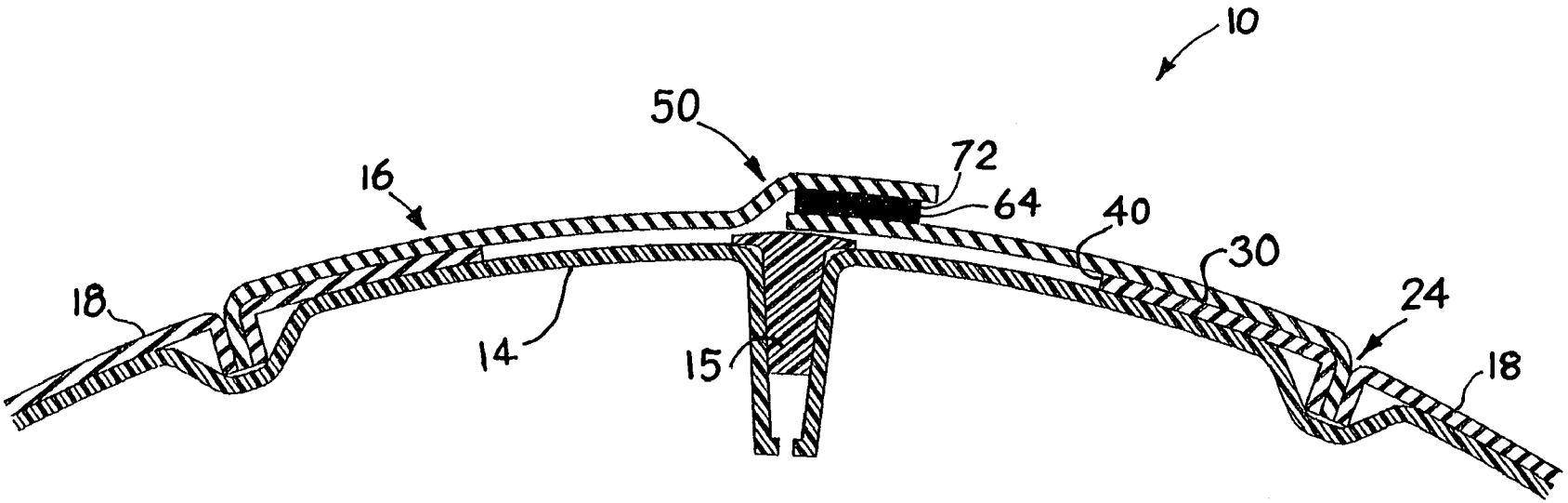
FIG. 4 is a cross-sectional view of the closure assembly taken along line 4-4 of FIG. 1 showing the access sections in a closed or sealed condition.

Turning now to the drawings, particularly FIGS. 1, 2 and 4, an inflatable bladder 14 is shown encased within jacket 16. The bladder 14 is rubber or other elastomeric material which is inflatable and deflatable through an air valve 15 and, when inflated, may be used for various activities depending on the size and shape of the bladder. When it becomes necessary to separate the bladder and jacket for repair or cleaning, the bladder is deflated at valve 15 and removed through the access section 20 in the jacket cover 18.

The jacket cover 18 is a durable, abrasion-resistant material. The access section 20 is configured to provide adequate clearance and space for bladder insertion, removal and inflation and access to the valve 15. The access section 20 is preferably a woven material having its weave pattern oriented to minimize and resist distortion of the jacket once the enclosed bladder is inflated within the jacket and helps to maintain the proper shape of the ball and allow proper directional stretch to assist in closure.

The cover, as shown in FIG. 1, has 32 panels and is a geometric figure having twenty (20) regular hexagonal panels and twelve (12) regular pentagonal panels P. The cover panels P are secured together along their edges in a suitable manner such as by stitching, adhesive, bonding or other means of securement at seams 24 to form cover 18, which when provided with an inflatable bladder is shown as an exercise ball having the appearance of a soccer ball 10.

According to the present invention, a selected one of the panels P of the cover 18 comprises the access section 20 to facilitate insertion and removal of the bladder. The shape and number of panels P may vary depending on user preference and intended use. The access section 20, as best seen in FIG. 2, includes an inner access panel 30 which is also shown as being generally hexagonal having sides 32 to 32E conforming to the configuration of the hexagonal panels P of the cover. As indicated, the shape of the access panel 30 may vary depending on the type, size and desired appearance of the ball 10. The inner access panel 30 may be round, oval, rectangular or other regular or irregular shape.

The inner access panel 30 is secured to the corresponding edges of the cover 18 along edges 34 to 34E along seams 24. The inner access panel defines a large opening 40, shown as circular, being of a generous selected size to accommodate insertion and removal of the bladder. The opening 40 may be any suitable shape such as round, oval, rectangular or other shape which facilitates insertion and removal of the bladder. The opening 40 is preferably centered within the inner access panel 30.

An outer closure 50 overlies the inner panel 30. The outer closure 50 comprises two panel sections 52, 54, each shown as being somewhat generally trapezoidal in shape, as best seen in FIG. 2. It will be appreciated that sections 52, 54 have a shape which is established by bisecting the inner panel 30. Thus, the shape of sections 52, 54 may vary depending on the shape of the cover panels P. As seen in FIG. 2, section 52 has outer peripheral edges 56A, 56B and 56C which are secured by stitching or bonding along the corresponding edges 32B, 32C and 32D of the inner access panel 30 at seam 24 when assembled. Transverse edge 56 extends across the opening 40 in the inner access panel 30 and an overlying closure flap 62 extends along edge 56. The inner side of the flap 62 is provided with a fastener shown as a section of hook-and-loop material 64.

The opposed section 54 is also shown as being trapezoidally shaped having outer edges 58A, 58B and 58C and a transversely extending edge 58. The edges 58A, 58B and 58C are secured along the corresponding outer edges 32A, 32 and 32E of the subjacent inner access panel 30 at seam 24. Flap 70 inward of the transverse edge 58 is provided with a closure such as a mating section of hook-and-loop fastener material 72 which will cooperate with the closure material 64 on flap 62. It will be appreciated that the shape of the panels may vary consistent with the geometry of the cover. The edges 56, 58 extend transversely across the center of opening 40 and access to the bladder is achieved by disengaging the closures on flaps 62 and 70.

If the inner access panel and outer panels are constructed from a woven fabric material having a warp and weft, generally at right angles, the direction of the warp and weft of the inner and outer panels are preferably oriented as shown by the arrows in FIG. 2. In this way, the weave of the inner panel is oriented to resist stretch perpendicular to the closure and the weave of the flaps on the outer panel sections are oriented to stretch to assist in closure. This orientation will reinforce the closure by resisting and distributing forces resulting from inflation of the bladder. A primary purpose of the inner panel is to strengthen the opening and equalizing stress forces in the surrounding seams without interfering with insertion, deflation, removal and inflation of the bladder. The reinforcement reduces localized deformation of the jacket at the access section, prevents rupture and tearing of the seams and assists in closing the outer panels. Reinforcement of the cover by the inner panel also permits higher inflation pressure which improves performance by increasing firmness, supporting more weight, allowing the ball to roll more freely and restricting relative movement between the bladder and cover. The weave orientation of the outer panel sections allows stretch to aid in closing the flaps.

Figure 3:
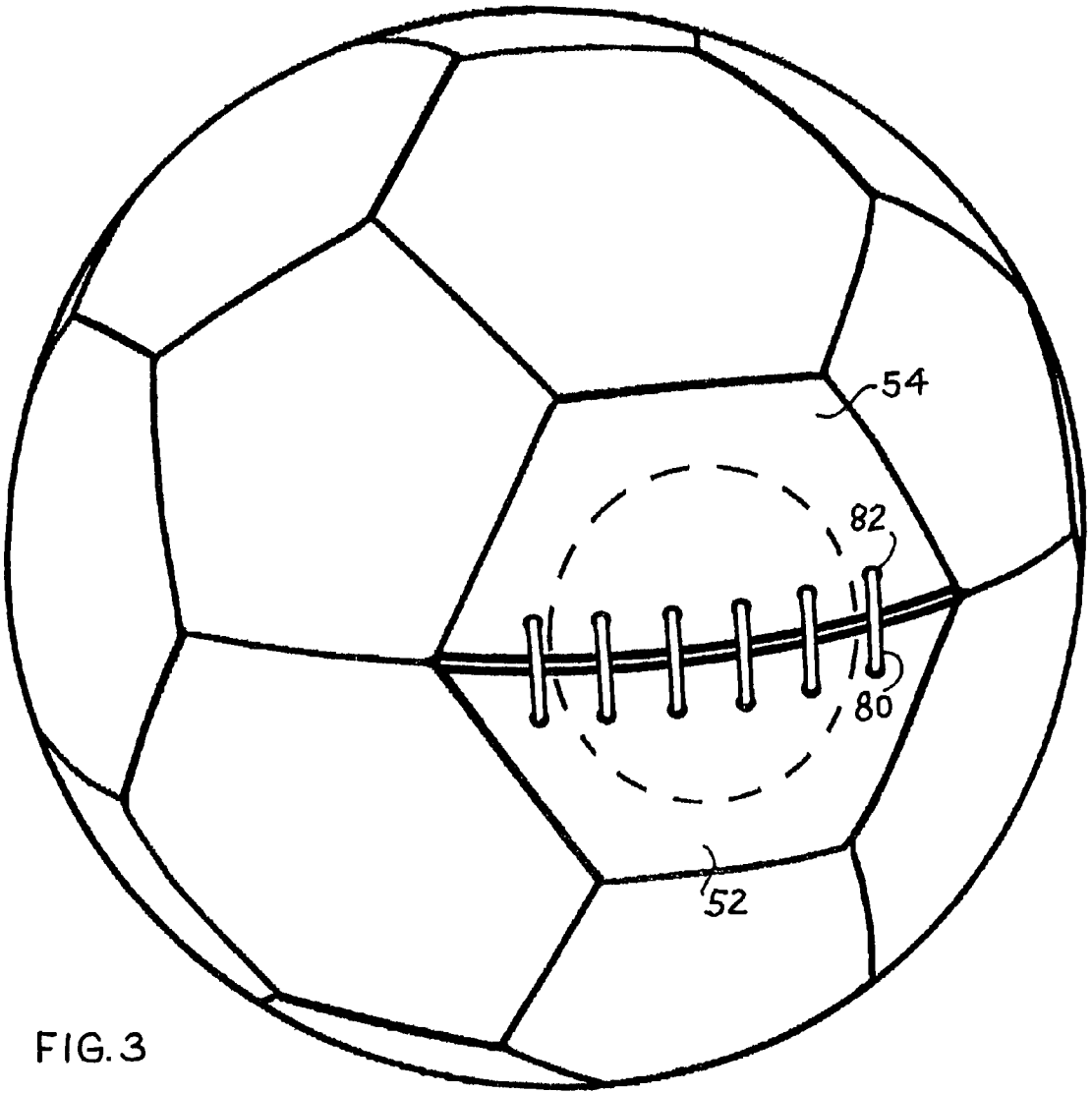
FIG. 3 is a perspective view similar to FIG. 1 showing an alternate embodiment in which the outer panels are detachably secured by removable lacing.

Without the inner panel on a jacket comprised of segments or panels concentrated stresses occur at the opening as a result of: 1) the segmented shape of the jacket cover only approximates a sphere, so different sections along the edges of the panels experience different degrees of stretch to accommodate the inflated ball; and 2) at least two seams (six are shown in FIG. 1) intersect the opening, and the mechanical properties of the seams differ from that of the adjacent unseamed material. The inner panel functions as multiple gussets equalizing the stress on all opening-intersecting seams and edges. For most covers having panels of uniform or regular shape, the preferred inner panel opening is one which is circular and centered resulting in the greatest equalization of the stresses. The outer panels also provide reinforcement to the opening, but that reinforcement is intermittent depending on whether the panels are fastened and non-uniform because of the asymmetry of their shape and securement. The fasteners provided on the outer panel sections may be, as indicated above, hook-and-loop material or may be other types of closures such as snap fasteners or, as seen in FIG. 3, may be laces 80 extending through eyelets 82 adjacent the abutting edges of the panels 52, 54 suitably secured. The laces will allow the outer panels 52, 54 to be separated providing access to the opening in the inner panel so that a deflated bladder may be removed or inserted and, once in place, may be suitably inflated.

The cover, as indicated, may be made from various woven and non-woven materials including durable synthetic fabrics such as coated nylon or non-woven materials such as vinyls. The cover and the panels may be a single or multiple ply material depending on the use. The cover, when applied, will increase the firmness of the ball once the ball is inflated. The cover provides a durable, protective, abrasion-resistant outer surface to increase the life of the ball. The appearance of the jacket may be customized using various colors, color combinations, logos and graphics.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A jacket for an inflatable bladder comprising:

(a) a woven fabric cover sized to encase the bladder in an inflated condition; and (b) an access section in said cover having:

(i) a woven fabric inner panel secured to said cover reinforcing said cover and defining an opening for insertion and removal of the bladder, the woven fabric inner panel comprising a weave oriented to resist stretch perpendicular to the closure; and (ii) a woven fabric outer closure overlying said inner panel, said outer closure having at least first and second panels each having an outer edge secured to said cover and having flaps extending across said opening being provided with cooperating fasteners to secure the outer panels over said opening which, in an open position, provide access for removal and insertion of the bladder within the cover and which in a closed position reinforces the closure to resist distorsional forces.

2. The jacket for an inflatable bladder of claim 1 wherein a weave of the outer closure panels is oriented to stretch in a direction to assist in securing the outer closure panels over the opening.

3. The jacket for an inflatable bladder of claim 1 wherein the cover is comprised of a plurality of geometric sections and the access section is configured to replace one of said geometric sections.

4. The jacket for an inflatable bladder of claim 1 wherein the cooperating closures are selected from the group consisting of hook-and-loop material, snaps, buttons, laces and zippers.

5. The jacket for an inflatable bladder of claim 1 wherein said inner panel and said outer panels are joined to said cover at a seam extending peripherally around said inner panel.

6. The jacket for an inflatable bladder of claim 1 wherein the shape of the inner panel and the outer panels are regular polygons.

7. The jacket for an inflatable bladder of claim 5 wherein the panels are attached to the cover at said seam by fasteners selected from the group consisting of sewing, adhesives, bonding and welding.

8. The jacket for an inflatable bladder of claim 1 wherein the opening in the inner panel is centered in the inner panel.

9. The jacket for an inflatable bladder of claim 1 wherein the opening in the inner panel is curvilinear.

10. A jacket for an inflatable ball bladder comprising:

(a) a cover having the shape of a truncated icosahedron comprised of a plurality of hexagonal and pentagonal panel sections;

(b) an access section in said cover in place of one of said panel sections having:

(i) an inner panel of woven material having edges secured to adjacent panel sections at a seam in said cover and defining a generally polygonal shape, said inner panel having a generally curvilinear opening for insertion and removal of the bladder, the inner panel reinforcing said cover;

(ii) an outer closure overlying said inner panel, said outer closure having first and second generally trapezoidal outer panels each having outer edges secured to the cover at adjacent panel sections and having flaps extending across said opening being provided with cooperating fasteners to secure the outer panels over said opening in a closed position and having an open position to provide access for removal and insertion of the bladder within the cover.

11. The jacket for an inflatable bladder of claim 10 wherein the inner panel is a woven material with the weave oriented to equalize the stress on the seams.

12. The jacket for an inflatable bladder of claim 10 wherein the outer closure panels are a woven material and the weave is oriented to stretch in a direction to assist in securing the flaps at said cooperating fasteners.

13. A jacket for an inflatable bladder comprising:

(a) a woven fabric cover sized to encase the bladder in an inflated condition; and (b) an access section in said cover having:

(i) a woven fabric inner panel secured to said cover reinforcing said cover and defining an opening for insertion and removal of the bladder; and (ii) a woven fabric outer closure overlying said inner panel, said outer closure comprising a weave oriented to stretch in a direction to assist in securing the outer closure panels over the opening and having at least first and second panels each having an outer edge secured to said cover and having flaps extending across said opening being provided with cooperating fasteners to secure the outer panels over said opening which, in an open position, provide access for removal and insertion of the bladder within the cover and which in a closed position reinforces the closure to resist distorsional forces.

14. The jacket for an inflatable bladder of claim 13 wherein the cover is comprised of a plurality of geometric sections and the access section is configured to replace one of said geometric sections.

15. The jacket for an inflatable bladder of claim 13 wherein the cooperating closures are selected from the group consisting of hook-and-loop material, snaps, buttons, laces and zippers.

16. The jacket for an inflatable bladder of claim 13 wherein said inner panel and said outer panels are joined to said cover at a seam extending peripherally around said inner panel.

17. The jacket for an inflatable bladder of claim 13 wherein the shape of the inner panel and the outer panels are regular polygons.

18. The jacket for an inflatable bladder of claim 16 wherein the panels are attached to the cover at said seam by fasteners selected from the group consisting of sewing, adhesives, bonding and welding.

19. The jacket for an inflatable bladder of claim 13 wherein the opening in the inner panel is centered in the inner panel.

20. The jacket for an inflatable bladder of claim 13 wherein the opening in the inner panel is curvilinear.

* * * * *